US010361025B2

(12) United States Patent
Iwakura et al.

(10) Patent No.: US 10,361,025 B2
(45) **Date of Patent: *Jul. 23, 2019**

(54) TRANSFORMER AND LEAKAGE TRANSFORMER

(71) Applicant: TDK Corporation, Minato-ku, Tokyo (JP)

(72) Inventors: Masaaki Iwakura, Tokyo (JP); Katsumi Kobayashi, Tokyo (JP); Masaru Kumagai, Tokyo (JP); Nobuo Kitajima, Tokyo (JP); Satoshi Shinbo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 160 days.

This patent is subject to a terminal disclaimer.

(21) Appl. No.: 15/214,042

(22) Filed: Jul. 19, 2016

(65) Prior Publication Data

US 2016/0329148 A1 Nov. 10, 2016

Related U.S. Application Data

(62) Division of application No. 14/472,053, filed on Aug. 28, 2014, now Pat. No. 9,424,982.

(30) Foreign Application Priority Data

Aug. 29, 2013 (JP) ..... 2013-177525
Jul. 23, 2014 (JP) ..... 2014-149886

(51) Int. Cl.
*H01F 27/30* (2006.01)
*H01F 27/34* (2006.01)
(Continued)

(52) U.S. Cl.
CPC ..... *H01F 27/346* (2013.01); *H01F 27/24* (2013.01); *H01F 27/2823* (2013.01);
(Continued)

(58) Field of Classification Search
CPC .. H01F 27/346; H01F 27/325; H01F 27/2823; H01F 27/24; H01F 27/2828;
(Continued)

(56) References Cited

U.S. PATENT DOCUMENTS 5,015,982 A 5/1991 Skinner et al.
5,155,676 A 10/1992 Spreen
(Continued)

FOREIGN PATENT DOCUMENTS

JP H08-264356 A 10/1996
JP 2005-228858 A 8/2005
(Continued)

*Primary Examiner* — Mang Tin Bik Lian
(74) *Attorney, Agent, or Firm* — Arent Fox LLP

(57) ABSTRACT

A transformer 10 comprises a bobbin 20. A cylinder portion 28 of the bobbin 20 is provided with a first winding part 35 where a first wire 37 is wound and a second winding part 36 where a second wire 38 is wound at a position different from the first winding part 35 in an axial direction. At an outer circumference of the cylinder portion 28 located between the first winding part 35 and the second winding part 36, an insulating partition collar 30 is formed. On the first winding part 35, a winding partition collar 33, separating in respective sections S1, S2, is formed. On the winding partition collar 33, at least one communication groove 33a, communicating the sections S1, S2 adjacent to each other is formed. The first wire 37 is α-wound around the first winding part 35.

10 Claims, 7 Drawing Sheets

(51) Int. Cl.
*H01F 27/28* (2006.01)
*H01F 27/32* (2006.01)
*H01F 27/24* (2006.01)

(52) U.S. Cl.
CPC ..... *H01F 27/2828* (2013.01); *H01F 27/324* (2013.01); *H01F 27/325* (2013.01)

(58) Field of Classification Search
CPC ..... H01F 27/34; H01F 27/28; H01F 27/32; H01F 27/29; H01F 5/04; H01F 5/02; H01F 2005/043; H01F 2005/046; H01F 2005/022
USPC ..... 336/192, 208, 198, 212, 220–222
See application file for complete search history.

(56) References Cited

U.S. PATENT DOCUMENTS 6,175,295 B1 * 1/2001 Honma ..... H01F 5/02 336/192
6,794,976 B2 * 9/2004 Sigl ..... H01F 27/38 219/670
9,424,982 B2 * 8/2016 Iwakura ..... H01F 27/2828
2002/0070833 A1 6/2002 Junjie et al.
2002/0175798 A1 * 11/2002 Sigl ..... H01F 27/325 336/198
2007/0268103 A1 * 11/2007 Fushimi ..... H01F 3/10 336/145
2008/0024262 A1 * 1/2008 Chang ..... H01F 27/02 336/208
2010/0156584 A1 * 6/2010 Yamaguchi ..... H01F 27/306 336/65
2010/0194306 A1 * 8/2010 Sugimura ..... H01F 27/30 315/291
2011/0043315 A1 * 2/2011 Kobayashi ..... H01F 27/2828 336/192
2012/0038448 A1 2/2012 Kim et al.
2012/0320505 A1 * 12/2012 Lee ..... H01F 27/29 361/679.01
2014/0253273 A1 9/2014 Suzuki et al.

FOREIGN PATENT DOCUMENTS

JP 2012-054488 A 3/2012
JP 2013-058528 A 3/2013

* cited by examiner

TRANSFORMER AND LEAKAGE TRANSFORMER

CROSS-REFERENCE TO RELATED APPLICATION

This is a Divisional Application of U.S. patent application Ser. No. 14/472,053, filed Aug. 28, 2014, which in turn is based upon and claims the benefit of priority of the Japanese Patent Application Nos. 2013-177525, filed Aug. 29, 2013, and 2014-149886, filed Jul. 23, 2014. The disclosures of the prior applications of which are each hereby incorporated in their entirety by reference.

BACKGROUND OF THE INVENTION

Field of the Invention

The present invention relates to a transformer that can be used as, for example, a leakage transformer.

Description of the Related Art

As a leakage transformer, for example, the transformer shown in the following Patent Document 1 is known. For the conventional transformer, in order to reduce iron losses, it is required to increase the number of turns of wire for windings so that a magnetic flux density is decreased. However, when the number of turns of wire increases, the size of the transformer becomes large and that causes a heat generation due to copper losses. Further, in order to realize a large-current in the transformer, it is required to make a wire diameter of wire for windings large. However, as a result of that, a coil winding part gets large and a ferrite core gets large as well. Accordingly, that causes problems such as insulation and an increase of iron losses.

Recently, as for the transformer used for, for example, a vehicle-mounted charger and the like, it is demanded to reduce (downsizing) a height and a plane size of the transformer while realizing a large-current in the transformer so as to correspond to high frequency (30 to 300 kHz). Further, it is also demanded to reduce losses of the transformer due to iron losses and copper losses in the transformer, and further to effectively dissipate the heat generated by the losses in the transformer.

Patent Document 1: Japanese Application Laid Open Publication No. H8-264356

SUMMARY OF THE INVENTION

It is therefore an object of the present invention to provide a transformer capable of securing an adjustment of leakage characteristics and having an excellent insulation property, and further capable of achieving a low height profile and downsizing of the transformer while realizing a large-current so as to correspond to high frequency, and having an excellent heat radiation.

In order to achieve the above object, the transformer according to the present invention comprises a bobbin, wherein the bobbin is provided with a cylinder portion on which a core leg penetrating hole, where a magnetic core is inserted, is formed, the cylinder portion is provided with a first winding part where a first wire, constituting either one of a primary coil or a secondary coil, is wound, and a second winding part where a second wire, constituting the another one of the primary coil or the secondary coil, is wound, at a position different from the first winding part in an axial direction, at an outer circumference of the cylinder portion located between the first winding part and the second winding part, an insulating partition collar is formed, at least on the first winding part, a winding partition collar, separating mutually adjacent wire winding parts along a winding axis of the first wire in respective sections, is formed, at the winding partition collar, at least one communication groove, communicating the sections adjacent to each other, is formed, and at least the first wire is α-would around the first winding part.

For the transformer according to the present invention, at the outer circumference of the cylinder portion located between the first winding part and the second winding part, the insulating partition collar is formed. This insulating partition collar has an excellent insulation property, which is capable of insulating between the primary coil and the secondary coil. Further, by adjusting a thickness of this insulating partition collar, it enables to adjust leakage characteristics. Such adjustment can be easily performed.

Further, for the transformer of the present invention, at the winding partition collar, at least one communication groove communicating each section adjacent to one another is formed. Therefore, through the communication groove, at least a first wire is easily α-wound around the first winding part. Further, for the α-winding, even if the number of turns increases, it enables to reduce the number of layers in the winding axis direction, with the result that it enables to contribute to low height profile and downsizing of the transformer. Further, by performing the α-winding, wires are not pulled out from a central part of the winding wire and thereby wires are not overlapped, with the result that it enables to contribute to low height profile of the transformer.

Further, for the transformer of the present invention, at least the winding partition collar, separating mutually adjacent wire winding parts along the winding axis of the first wire, is formed. Therefore, even if the outer diameter of the wire is made to large, insulation can be easily achieved and it enables to apply for a large-current (high output). Further, conventionally, as the frequency of voltage increases, mutually adjacent coils interact with each other (bad influence) and that resulted in restriction of the current flow. However, for the transformer of the present invention, there is provided the winding partition collar, with the result that it enables to reduce the above bad influence and improve the high frequency property. Furthermore, the winding partition collar and the insulating partition collar also serve as heat radiating fins, with the result that the heat radiation of the transformer can be improved.

Preferably, each section width, along the winding axis, in respective sections separated by the winding partition collar is set so that the only one wire can pass through in the winding axis direction. Further a height of the winding partition collar is set so that one or more of the wires can pass through in the height direction.

In each section, the wire is wound so that only single wire exist along the winding axis direction, with the result that it enables easily to prevent fluctuation in the number of turns of wire per a layer and enables to contribute to stability of the leakage characteristics. Specifically, it becomes easier to exactly control a coupling coefficient K between the primary coil and the secondary coil and it enables preferably to use the coil device of the present invention as a leakage transformer.

Preferably, on the second winding part, the winding partition collar, separating mutually adjacent wire winding parts along the winding axis of the second wire in respective sections, is formed. On the winding partition collar, at least one communication groove, communicating the sections adjacent to each other, is formed. Further, the second wire is α-wound around the second winding part.

By forming the second winding part as with the first winding part, the effects of the present invention increase.

Preferably, at the core leg penetrating hole, a split leg portion of split core having a U-shaped cross-section is inserted.

According to experiments conducted by the present inventors, with the above structure, even if the size of core becomes large, the local stress generated on an intersection between a middle leg and a base can be dispersed, in comparison with the case using a conventional E-type core. Therefore, for the transformer of the present invention, it enables to effectively inhibit a generation of cracks even if thermal stress generates on the core.

Further, the middle leg and the base of the E-type core which is formed by combining split cores is separated at split surfaces of the split cores and it enables to form a predetermined gap between the split surfaces, with the result that the heat radiation improves. Further, the E-type core is formed by combining a pair of split cores respectively having a simple shape and therefore it enables to realize a downsizing. With that, it enables to facilitate the manufacture of cores and further enables to reduce manufacturing costs. Furthermore, for the split E-type core as a whole, it has magnetic lines identical with the E-type core, therefore the magnetic property of this core is identical with the general E-type core.

At the inner circumference of the cylinder portion forming the core leg penetrating hole, a protruding portion for separation may be formed so that the mutual split cores are opposed to each other at a predetermined gap.

The transformer of the present invention may have a cover attached on the outer circumference of the bobbin to guide the side legs of the magnetic core. The cover protects the outer diameter of the bobbin and also guides the side legs of the magnetic core, with the result that it enables easily to attach the magnetic core.

At the end portions of the cylinder portion of the winding axis direction, end partition collars are respectively formed, and a thick wall part is provided near the core leg penetrating hole on either one of the end partition collars. On an outer circumference of the thick wall part, a second engagement part where a first engagement part provided on an engagement piece of the cover engages may be formed.

With the above structure, it enables to improve the strength of the bobbin. Further, only minimum parts are made to be thick, with the result that it enables to achieve a thin type and downsizing of the transformer in the winding axis direction.

Further, in the present invention, the predetermined gap is preferably 0.05 to 5 mm, further preferably 0.1 to 3 mm. These predetermined gaps are not necessarily formed on the entire surface between the split surfaces of the split cores.

At least a lower part of the transformer along the winding axis direction may be placed in a casing and may contact with heat radiation resin. By contacting with the heat radiation resin, heat radiation of the middle leg further improves.

The heat radiation resin may be filled between the split surfaces of the core. Particularly, by interposing the heat radiation resin on a protruding tip of the core portion which is inserted in the core penetrating hole, it enables to effectively dissipate the heat on that part.

DESCRIPTION OF THE PREFERRED EMBODIMENTS

The following is explanations of the present invention based on embodiments illustrated in FIGS.

First Embodiment

Figure 1:
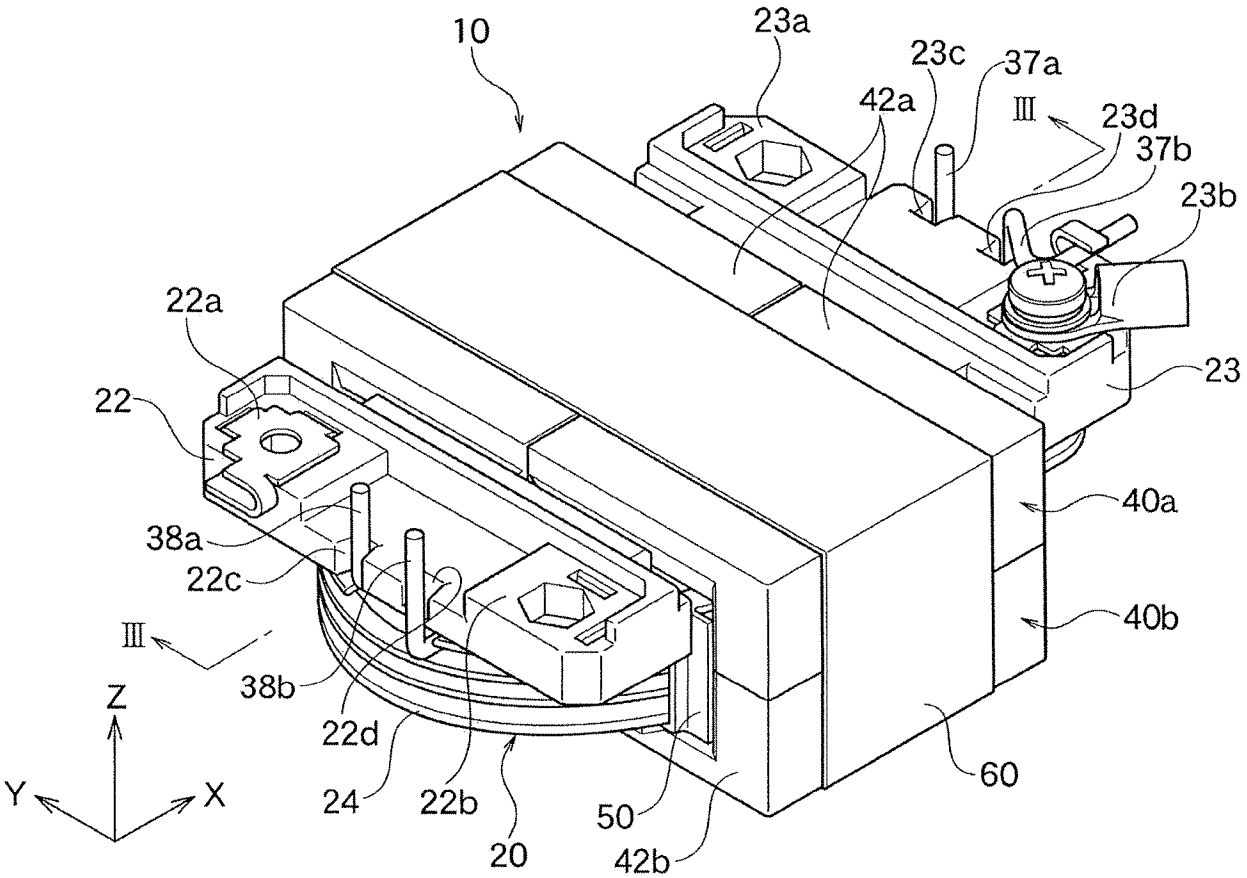
FIG. 1 is an overall perspective view of the transformer according to one embodiment of the present invention.

The transformer 10 according to the present embodiment illustrated in FIG. 1 is used, as a leakage transformer, for a vehicle-mounted charger and the like. This transformer 10 is provided with a bobbin 20, magnetic cores 40*a*, 40*b*, a cover 50, and a tape-shaped member 60.

Figure 2:
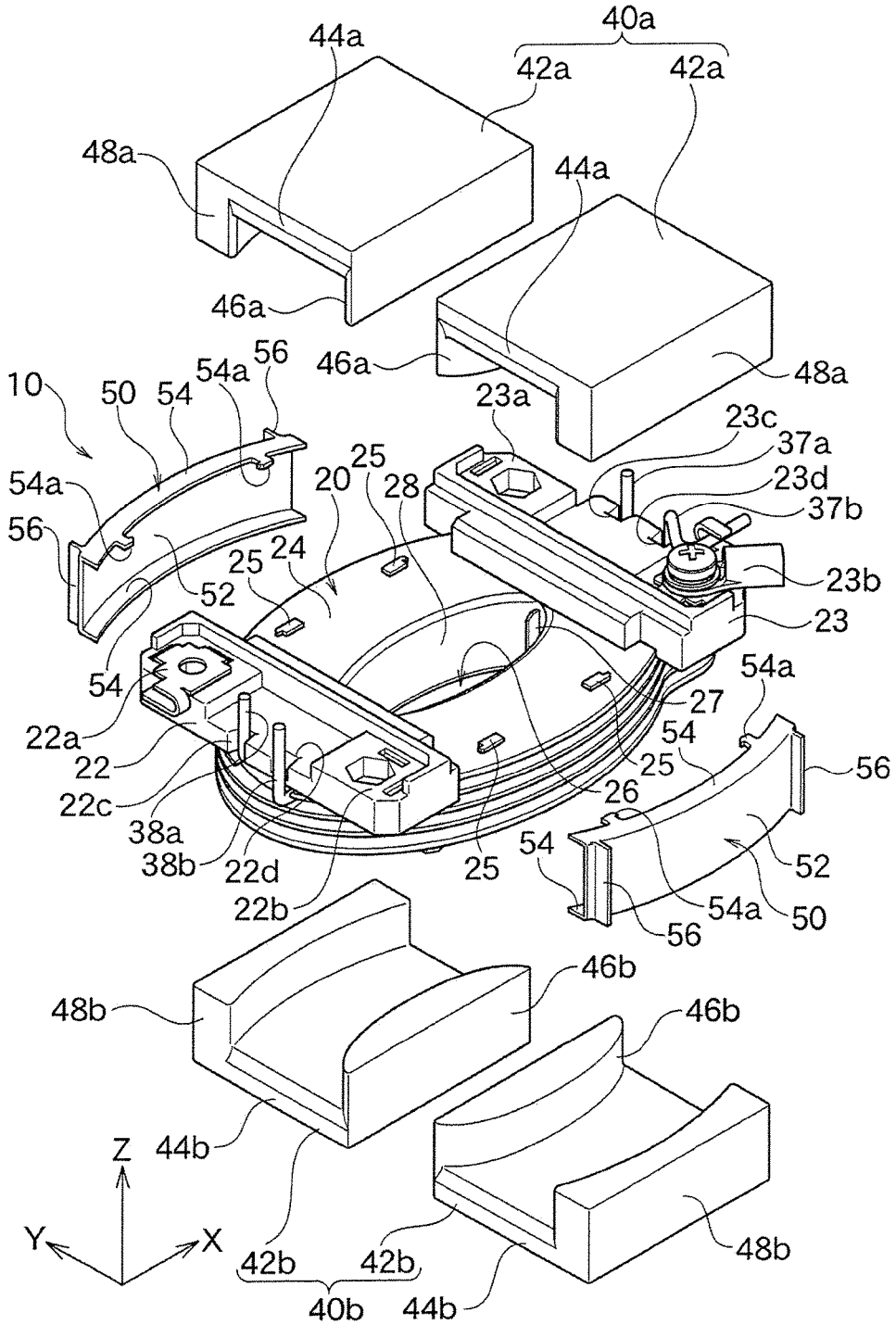
FIG. 2 is an exploded perspective view of the transformer illustrated in FIG. 1.

As illustrated in FIG. 2, the bobbin 20 is provided with a bobbin body 24, and terminal block parts 22, 23 which are integrally formed on the upper part of both ends of the bobbin body 24 in the X-axial direction. On the terminal block parts 22 and 23, terminal attaching portions 22*a*, 22*b* and 23*a*, 23*b* are respectively formed on both ends of the Y-axis direction, and terminals are attached thereon. Each terminal is connected with lead portions 37*a*, 37*b* of the first wire 37 and lead portions 38*a*, 38*b* of the second wire 38, which will be described below.

At the central part of the terminal block parts 22 and 23 in the Y-axis direction, lead grooves 22*c*, 22*d* and 23*c*, 23*d*, respectively leading lead portions 37*a*, 37*b* and 38*a*, 38*b* to the upper part of the Z-axis direction, are formed.

As illustrated in FIG. 2, in the present embodiment, the magnetic cores 40*a*, 40*b* can be separated into two split cores 42*a*, 42*a* and 42*b*, 42*b* respectively having the same shapes. In the present embodiment, all of the split cores 42*a*, 42*a* and 42*b*, 42*b* have the same shapes exhibiting a U shape on the Z-Y cross section, and they relate to U-shaped core. By combining a pair of the split cores 42*a*, 42*a* arranged on the upper part of the Z-axis direction, the Z-Y cross section has an E shape and a so-called E type core is formed. For the other pair of the split cores 42*b*, 42*b* arranged on the lower part of the Z-axis direction, by combining them, the Z-Y cross section has an E shape and a so-called E type core is formed.

Each split core 42*a* arranged on the upper side of the Z-axis direction is provided with a base portion 44*a* extending in the Y-axis direction and a pair of middle leg portion 46*a* and side leg portion 48*a* protruding toward the Z-axis direction from both ends of the base portions 44*a* in the Y-axis direction. Each split core 42*b* arranged on the lower side of the Z-axis direction is provided with a base portion 44*b* extending in the Y-axis direction and a pair of middle leg portion 46*b* and side leg portion 48*b* protruding towards the Z-axis direction from both ends of the base portion 44*b* in the Y-axis direction.

Figure 3:
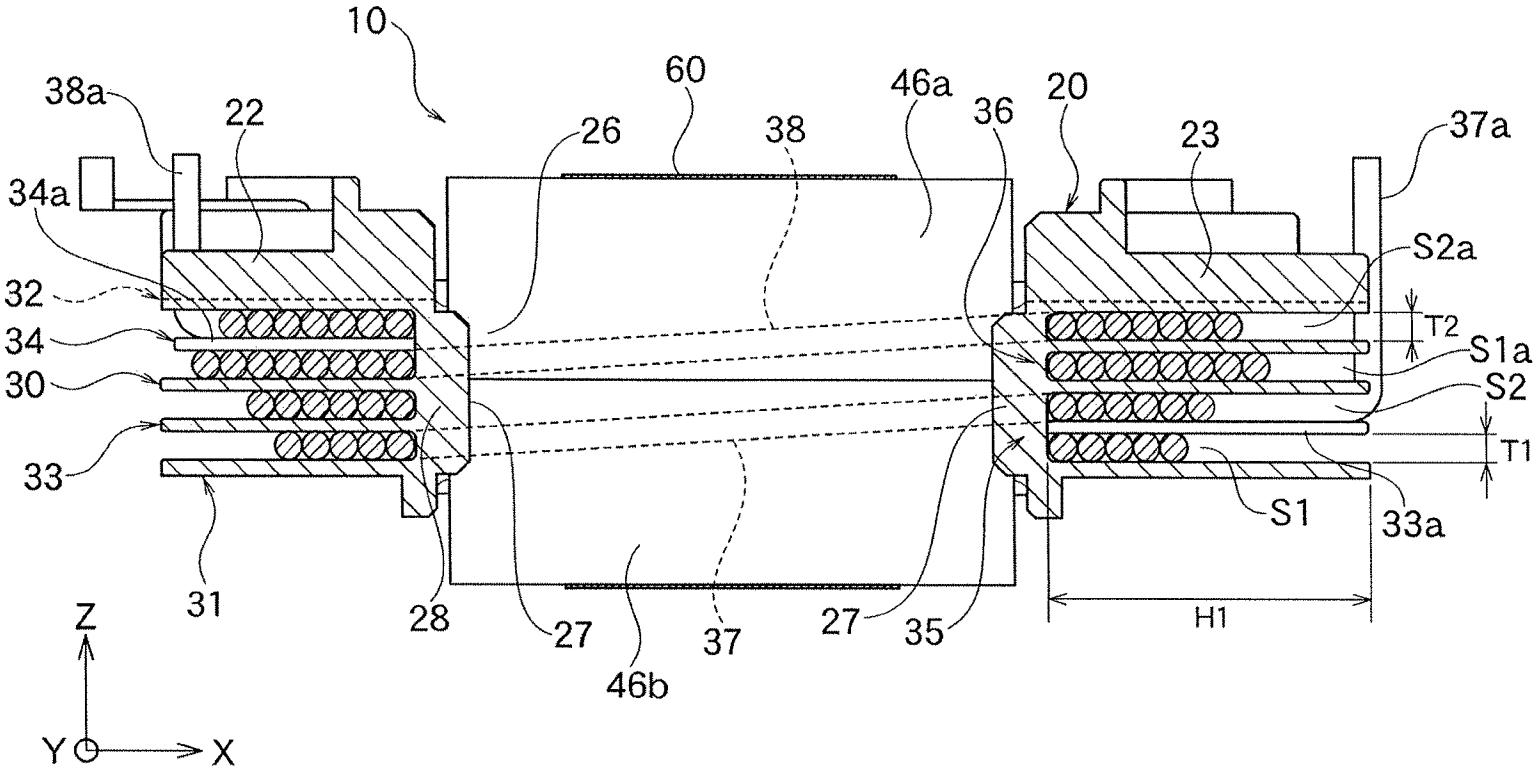
FIG. 3 is a partial cross-sectional view of the transformer along the lines illustrated in FIG. 1.

As illustrated in FIG. 3, the pair of middle leg portions 46*a* are inserted into the core leg penetrating hole 26 of the bobbin 20 from the upper part of the Z-axis direction. Similarly, the pair of middle leg portions 46*b* are inserted into the core leg penetrating hole 26 of the bobbin 20 from the lower part of the Z-axis direction, and tips thereof contact with those of the middle leg portions 46*a* or are opposed to those of the middle leg portions 46*a* at a predetermined gap.

On the opposed position, in the X-axis direction, at the inner circumferential surface of a winding cylinder portion 28 forming the penetrating hole 26, a protruding portion 27 for separation (refer to FIG. 2) is formed along the Z-axis direction. The protruding portion 27 for separation is interposed between the middle leg portions 42*a*, 42*a* as well as between the middle leg portions 42*b*, 42*b*. Further, in the penetrating hole 26, these middle leg portions 42*a*, 42*a* or middle leg portions 42*b*, 42*b* are opposed to each other at the predetermined gap and they do not contact with each other. The predetermined gap can be adjusted by the thickness of the protruding portion 27 for separation of the Y-axis direction.

The middle leg portions 42*a*, 42*a* or the middle leg portions 42*b*, 42*b* are respectively combined and have an elliptic columnar shape which is longer in the X-axis direction so that they corresponds to the inner circumferential surface shape of the penetrating hole 26. However, the shape is not particularly limited and may be changed according to the shape of the penetrating hole 26. Further, the side leg portions 48*a*, 48*b* have an inner recessed curved surface shape corresponding to the outer circumferential surface shape of a cover body 52 of cover 50, and the outer surface thereof has a plane surface parallel to the X-Z plane. In the present embodiment, for the material for each split core 42*a*, 42*b*, soft magnetic materials such as metal and ferrite are exemplified. However, it is not particularly limited to the above only.

The cover body 52 of the cover 50 has a shape covering the outer circumference of the bobbin body 24 placed between terminal blocks 22 and 23 of the bobbin 20. On both ends of the cover body 52 of the Z-axis direction, engagement pieces 54, bending substantially vertically from the cover body 52, toward the bobbin body 24, are integrally formed. The pair of engagement pieces 54 formed on both ends of the cover body 52 of the Z-axis direction is attached so as to sandwich upper and lower surfaces of the bobbin body 24 of the Z-axis direction.

On the upper surface of the bobbin body 24, the protruding engagement part 25 is formed, and it detachably engages with the hook-shaped engagement part 54*a* formed inside the engagement piece 54 of the upper side of the cover 50.

Further, on the outer surfaces of both ends of the cover body 52 of the X-axis direction, side leg guide pieces 56, respectively extending in the Z-axis direction, are integrally formed. At the outer surface of the cover body 52 located between the pair of side leg guide pieces 56, the inner surface of the side leg portions 48*a*, 48*b* contacts, with the result that the movement of the side leg portions 48*a*, 48*b* in the X-axial direction is restricted by the pair of side leg guide pieces 56.

Further, in FIGS., X-axis, Y-axis and Z-axis are perpendicular to one another, and the Z-axis corresponds to the winding axis of the first wire 37 and the second wire 38, which will be described below, and further corresponds to a height (thickness) of the transformer 10. In the present embodiment, the lower part of the transformer 10 of the Z-axis direction becomes a mounting surface of the transformer. Further, the Y-axis corresponds to a direction in which the pair of split cores 42*a*, 42*a* or the pair of split cores 42*b*, 42*b* is separated. Further, the X-axis corresponds to a longitudinal direction of the middle leg portions 46*a*, 46*b*.

As illustrated in FIG. 3, at both ends, in the Z-axis direction, of the winding cylinder portion 28 of the bobbin 20 of the transformer 10 in the present embodiment, the end partition collars 31 and 32 are integrally formed, approximately parallel to the X-Y plane, so that they extend outwardly in the radial direction. On the winding cylinder portion 28 located between the end partition collars 31 and 32 in the Z-axis direction, the first winding part 35 and the second winding part 36 are continuously formed at different positions in the Z-axis direction. At the first winding part 35, the first wire 37 forming either one of the primary coil or the secondary coil is wound. Further, at the second winding part 36, the second wire 38 forming another one of the primary coil or the secondary coil is wound.

In the present embodiment, at the outer circumference of the winding cylinder portion 28 located between the first winding part 35 and the second winding part 36, the insulating partition collar 30 which is approximately parallel to the X-Y plane is formed. At least on the first winding part 35, the winding partition collar 33, separating mutually adjacent wire winding parts along the winding axis (Z-axis) of the first wire 37 in each section S1, S2, is formed.

Further, in the present embodiment, on the second winding part 36, the winding partition collar 34, separating mutually adjacent wire winding parts along the winding axis (Z-axis) of the second wire 38 in each section S1*a*, S2*a*, is formed. On each winding partition collars 33 and 34, at least one communication grooves 33*a*, 34*a*, communicating each section S1, S2 or S1*a*, S2*a* which are adjacent to each other, are formed.

In the present embodiment, preferably, these communication grooves 33*a*, 34*a* are respectively formed in the opposite sides of the X-axis direction. These communication grooves 33*a*, 34*a* are respectively formed to have such a depth as to reach the outer circumferential wall of the winding cylinder portion 28, at a part of each partition collars 33 and 34 of the circumferential direction.

Further, on the insulating partition collar 30 and the end partition collars 31 and 32, communication grooves are not formed. However, shallow lead grooves (not illustrated in FIGS) for guiding lead portions 37*a*, 37*b* upward in the Z-axis direction may be formed. In the present embodiment, lead grooves 23*c*, 23*d* for guiding the lead portions 37*a*, 37*b* upward in the Z-axis direction are formed on the terminal block 23. Further, similarly, lead groves 22*c*, 22*d* for guiding lead portions 38*a*, 38*b* upward in the Z-axis direction are formed on the terminal block 22.

In the first winding cylinder portion 35, the first wire 37 is wound around the sections S1, S2 which are separated in the Z-axis direction by the partition collars 30, 33 and 31, with the result that wire winding parts can be mutually separated in each section S1, S2. In the present embodiment, the section width T1, along the X-axis, in each section S1, S2 is set so that only one wire 37 can pass through. However, in the present embodiment, the section width T1 may be set so that two or more of wires 37 can pass through. Further, in the present embodiment, although the section widths T1 all are preferably the same, they may be slightly different.

In the second winding cylinder portion 36, the second wire 38 is wound around the sections S1*a*, S2*a* which are separated in the Z-axis direction by the partition collars 30, 34, and 32 as with the first winding cylinder portion 35, with the result that the wire winding parts can be mutually separated in each Section S1*a*, S2*a*. In the present embodiment, the section width T2, along the X-axis, in each section S1*a*, S2*a* is set so that only one wire 38 can pass through. In the present embodiment, the section width T2 may be the same with or different from the section width T1 according to a wire diameter of the wire 38.

Further, the heights H1 of the partition collars 30 to 34 are set so that one or more of (one layer or more) wires 37 or 33 can pass through. In the present embodiment, the above heights are preferably set so that two to four layers of wires can be wound. Although the heights HI of each partition collar 30 to 34 all are preferably the same, they may be different.

In the present embodiment, at least the first wire 37 is α-wound around the first winding part 35 using communication grooves 33*a* which is formed on the winding partition collar 33. However, preferably, the second wire 38 is also α-wound around the second winding part 36 using communication grooves 34*a* which is formed on the winding partition collar 34. For the α-winding, it will be described below.

In the present embodiment, the bobbin 20 is composed of plastics such as PPS, PET, PBT, and LCP. However, it may be composed of the other insulating members. Further, the cover 50 is composed of insulating members such as plastics as with the bobbin 20.

Figure 4:
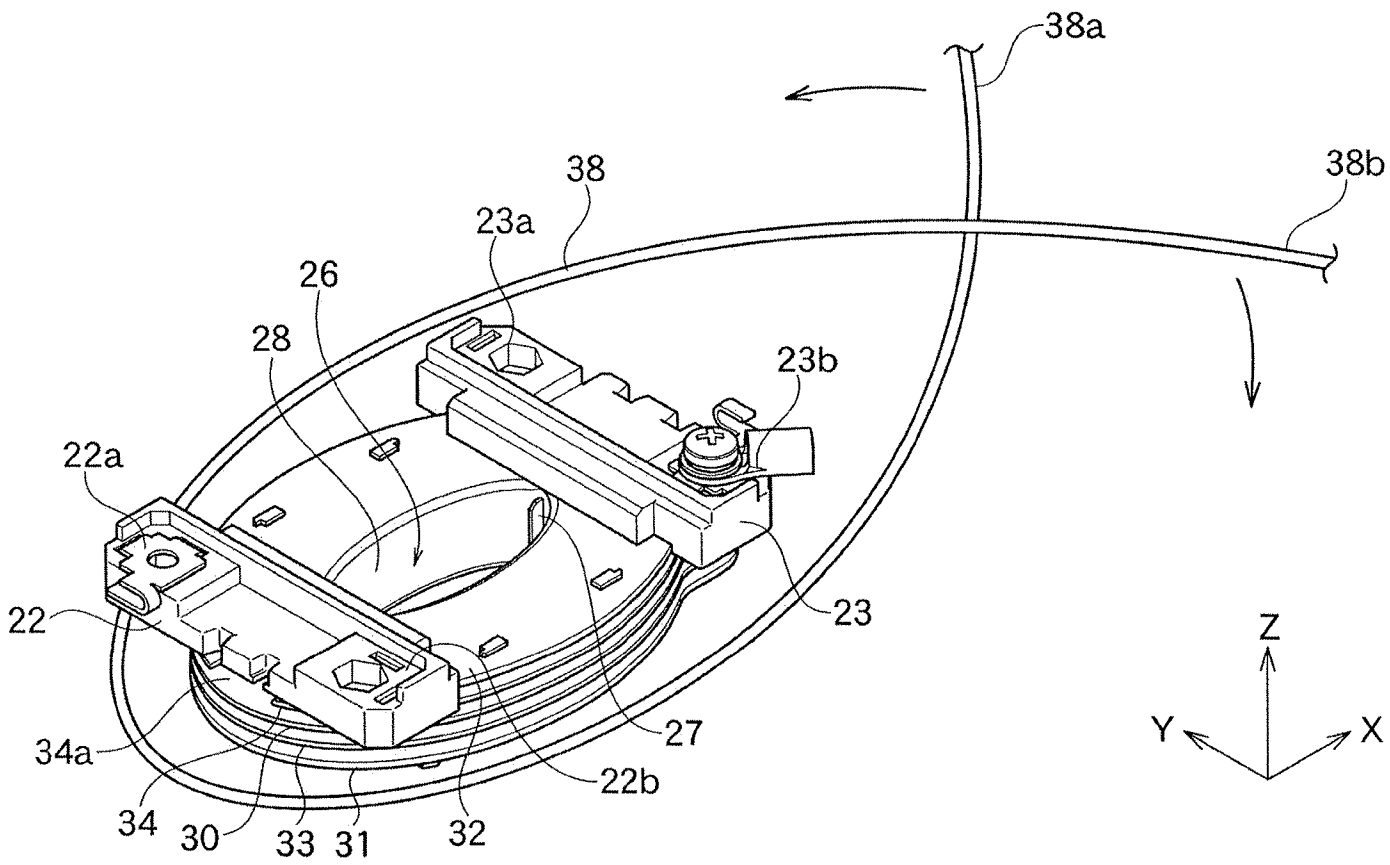
FIG. 4 is a perspective view explaining the α-winding of wire around a bobbin.

Next, the following is explanations regarding the α-winding. As for the windings of wires for forming coils, the α-winding itself is known. However, in the present embodiment, the α-winding was performed using the winding partition collars 33, 34 having communication groves 33*a*, 34*a*. For example, as illustrated in FIG. 4, in order that the second wire 38 is α-wound among partition collars 32, 34, and 30, first, the central part of the wire 38 placed at the nearly center between the lead portions 38*a*, 38*b* is passed through the communication groove 34*a*.

After that, a part of the wire 38 at the side closer to the lead portion 38*a* is wound, in a counterclockwise direction, around the outer circumference of the second winding part 36 in a plurality of layers inside of the section S1*a* illustrated in FIG. 3. At the same time, the other part of the wire 38 at the side closer to the lead portion 38*b* is wound, in a direction opposite to the direction of windings in the section S1*a* (or, may be in the same direction), around the outer circumference of the second winding part 36 in a plurality of layers inside of the section S2*a*.

Further, at the first winding part 35, the α-winding can be performed using different wires 37. These operations may be performed by using an automatic winding machine. Further, the wires 37 and 38 may be composed of single wire or may be composed of twisted wire, and further, they are preferably composed of insulation coated conductive wire. Although the outer diameter of the wires 37 and 38 is not particularly limited, it is preferably φ1.0 to φ3.0 mm for example, when the large-current is flowed. The second wire 38 may be the same with the first wire 37. However, it may be different from the first wire 37.

After the wires 37 and 38 are respectively wound around the bobbin 20, as illustrated in FIG. 2, a pair of cover 50 is attached to the bobbin 20. After that, the middle leg portions 46*a* of the pair of split cores 42*a*, 42*a* which are separated in the Y-axis direction and the middle leg portions 46*b* of the pair of split cores 42*b*, 42*b* which are separated in the Y-axis direction are inserted from both ends of the core leg penetrating hole 26 in the Z-axis direction.

As a result, as illustrated in FIG. 3, tips of leg portions 46*a*, 46*b* in the Z-axial direction are butted to each other inside of the penetrating hole 26. The tips of the leg portions 46*a*, 46*b* in the Z-axial direction may directly contact with each other, or may be faced each other at a predetermined gap. In any case, the leg portions 46*a*, 46*b* of separatable magnetic core are inserted into the penetrating hole 26 to form a magnetic circuit.

After that, as illustrated in FIG. 1, the outer circumference of the magnetic cores 40*a*, 40*b* is covered by a tape-shaped member 60 to fix the split cores 42*a*, 42*b* so as not to separate. The tape-shaped member 60 is composed of materials such as PET, PPC, and Papers. In order to providing heat radiation to the tape-shaped member 60, the tape-shaped member 60 is preferably composed of materials having more excellent pyroconductivity than the magnetic cores 40*a*, 40*b*. Specifically, the tape-shaped member 60 is composed of materials having excellent pyroconductivity, such as metals like aluminum and copper or alloys thereof. Obviously, as the tape-shaped member 60, tape-shaped members composed of the above-mentioned various materials may be combined to use. Further, these split cores 42*a*, 42*b* may be fixed to the bobbin 20 by an adhesive.

For the transformer 10 according to the present embodiment, at the outer circumference of the winding cylinder portion 28 located between the first winding part 35 and the second winding part 36, the insulating partition collar 30 is formed. This insulating partition collar 30 has an excellent insulation property, capable of insulating between the primary coil and the secondary coil. Further, by adjusting the thickness of this insulating partition collar 30, it enables to adjust the leakage characteristics. This adjustment can be easily performed.

Further, for the transformer 10 of the present embodiment, on the winding partition collar 33 (34), at least one communication groove 33*a* (34*a*) communicating each section S1, S2 adjacent to each other is formed. With this, it becomes easy that at least the first wire 37 is α-wound around the first winding part 35 through the above communication grooves 33*a* (34*a*). Further, for the α-winding, even if the number of turns increases, it enables to reduce the number of layers in the winding axis direction and therefore it enable to contribute to a downsizing of the transformer 10.

Further, for the transformer 10 of the present embodiment, the winding partition collar 33 (34), separating mutual wire winding parts adjacent to each other along the winding axis (Z-axis) of the wire 37 (38), is formed. Therefore, even if the outer diameter of the wire 37 (38) is made to be large, insulation can be easily performed and it enables to apply for the large-current (high output). Further, conventionally, as the frequency of voltage increases, each wire adjacent to each other interacts with each other and that results in restriction of the current flow. However, for the transformer 10 of the present embodiment, there is provided a winding partition collar 33 (34), with the result that it enables to reduce the above bad interaction and to improve the high frequency property. Furthermore, the end partition collars 31, 32, winding partition collars 33, 34, and insulating partition collar 30 also serve as heat radiating fins, with the result that the heat radiation of the transformer 10 can be improved.

Further, in the present embodiment, the wire 37 (38) is wound so that only single wire exist along the winding axis, in each section S1, S2 (S1*a*, S2*a*), with the result that it enables to easily prevent fluctuations in the number of turns of the wire 37 (38) per a layer and it enables to contribute to a stability of the leakage characteristics. Specifically, it becomes much easier to exactly control the coupling coefficient K between the primary coil and the secondary coil, and the transformer 10 of the present embodiment can be preferably used as a leakage transformer.

Further, in the present embodiment, the split leg portions 46*a*, 46*b* of the split cores 42*a*, 42*b* having a U-shaped cross-section are inserted into the core leg penetrating hole 26 of the bobbin 20. According to the experiments conducted by the present inventors, with the above structure, even if the size of core becomes larger, the local stress generated on an intersection between a middle leg and a base can be dispersed, in comparison with the case using a conventional E-type core. Therefore, for the transformer 10 of the present embodiment, it enables to effectively inhibit a generation of cracks even if thermal stress generates on the core.

Further, the middle legs 46*a*, 46*b* and the base of the E-type core which is formed by combining the split cores 42*a*, 42*b* are separated at a split surface of the split cores 42*a*, 42*b* and it enables to form a predetermined gap between the split surfaces, with the result that the heat radiation improves. Further, the E-type core is formed by combining the pair of split cores 42*a*, 42*b* respectively having a simple shape, with the result that it enables to facilitate the manufacture of cores and further enables to reduce manufacturing costs. Furthermore, for the split E-type cores as a whole, it has magnetic lines identical with the E-type core, therefore magnetic property of this core is identical with the general E-type core.

Further, in the present embodiment, in order for opposing the mutual split cores 42*a* (42*b*) at a predetermined gap, a protruding portion 27 for separation may be formed on the inner circumference of the winding cylinder portion 28 forming the core leg penetrating hole 26. In such case, the predetermined gap is preferably 0.05 to 5 mm, further preferably 0.1 to 3 mm. These predetermined gaps are not necessarily formed on the entire surface between split surfaces of the split cores.

In the present embodiment, at least a lower part of the transformer 10 along the winding axis (Z-axis) direction may be placed in a casing (abbreviated in FIGS.) and may contact with heat radiation resin (potting resin). By contacting with the heat radiation resins, heat radiation of the middle legs 46*a*, 46*b* further improves.

The heat radiation resins may be filled between the split surfaces of the split cores 42*a*, 42*b*. Particularly, by interposing the heat radiation resin on the protruding tip of core portion which is inserted in the core penetrating hole 26, it enables to effectively dissipate the heat on that part.

Second Embodiment

Figure 5:
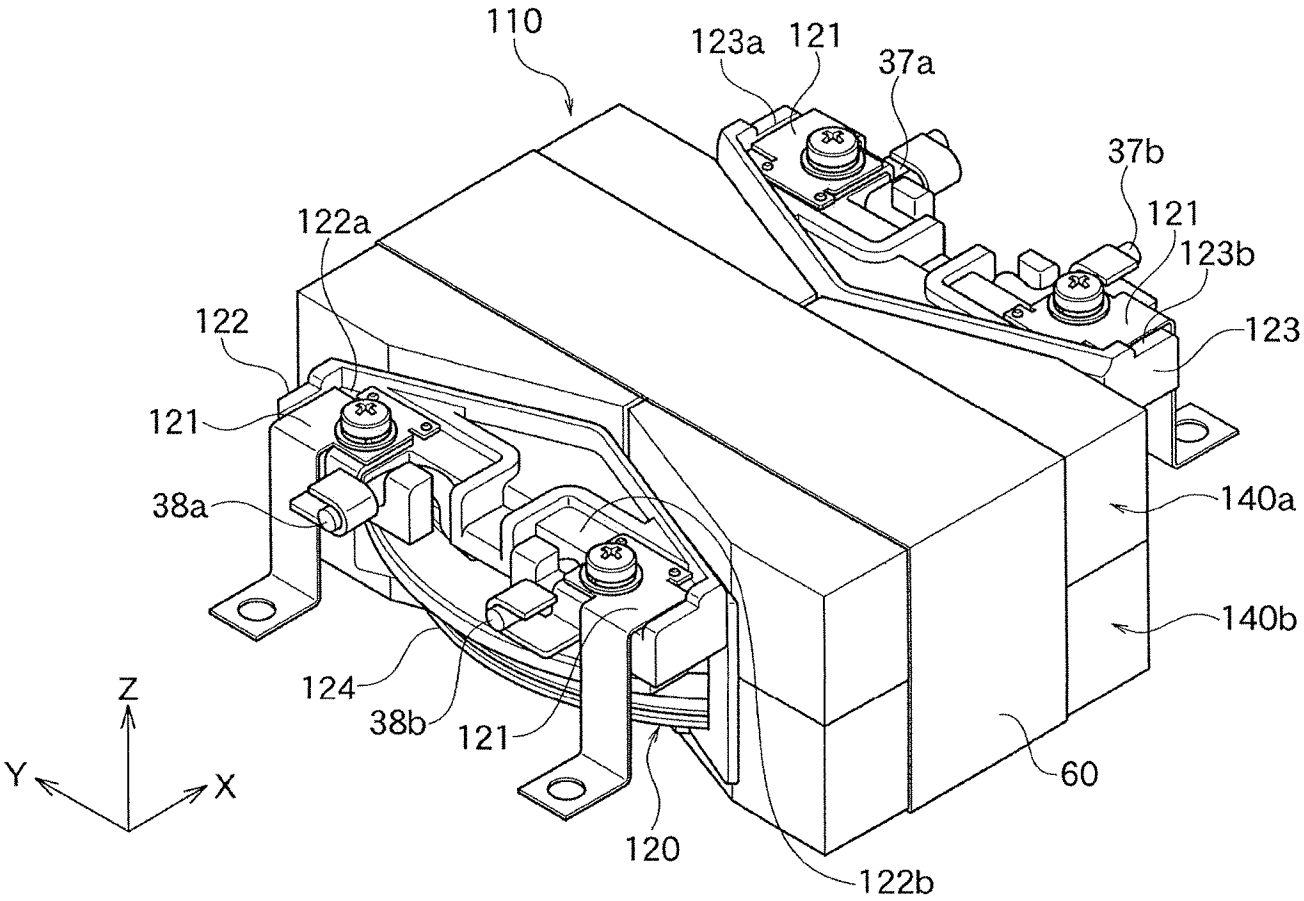
FIG. 5 is an overall perspective view of the transformer according to the other embodiment of the present invention.
Figure 6:
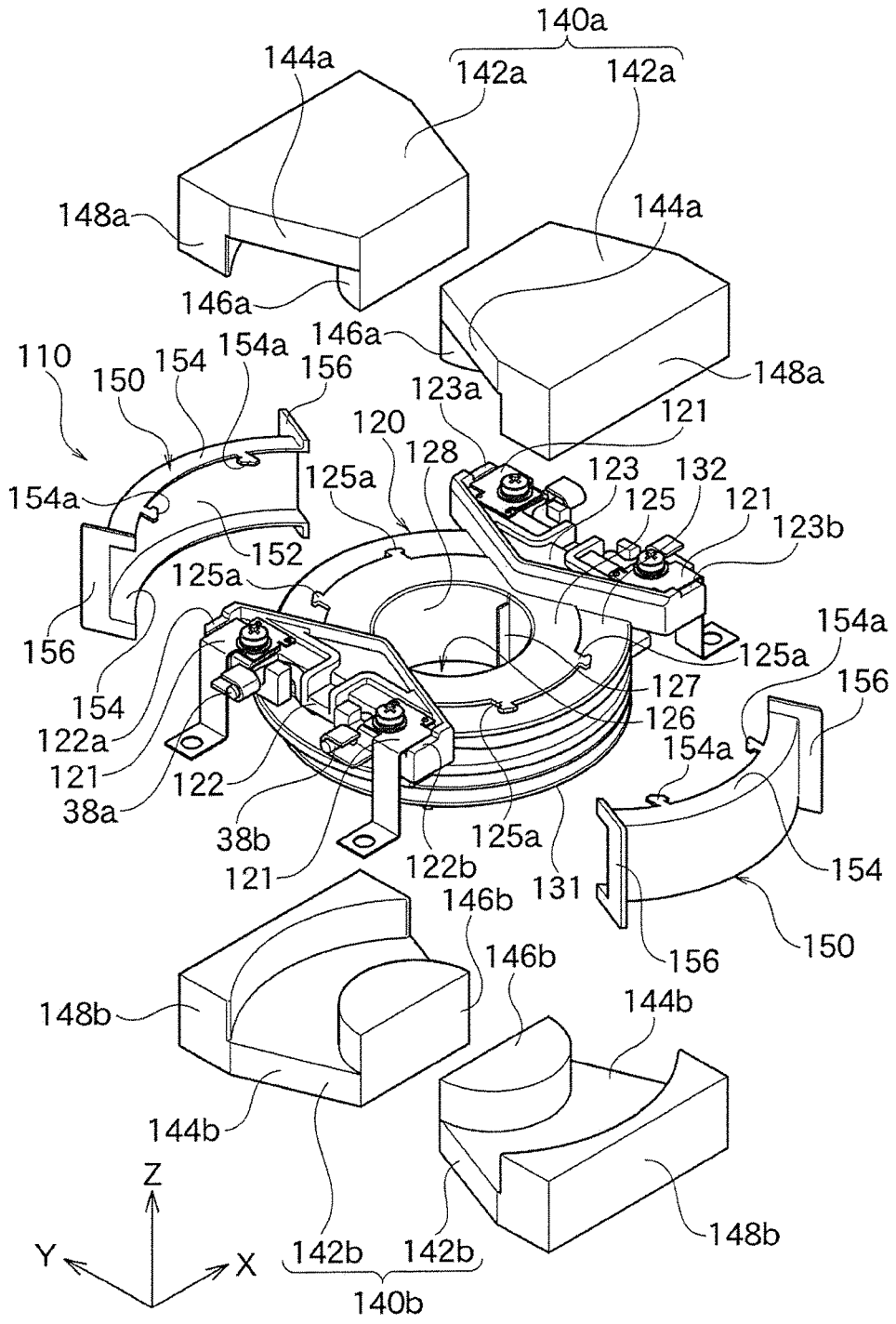
FIG. 6 is an exploded perspective view of the transformer shown in FIG. 5.
Figure 7:
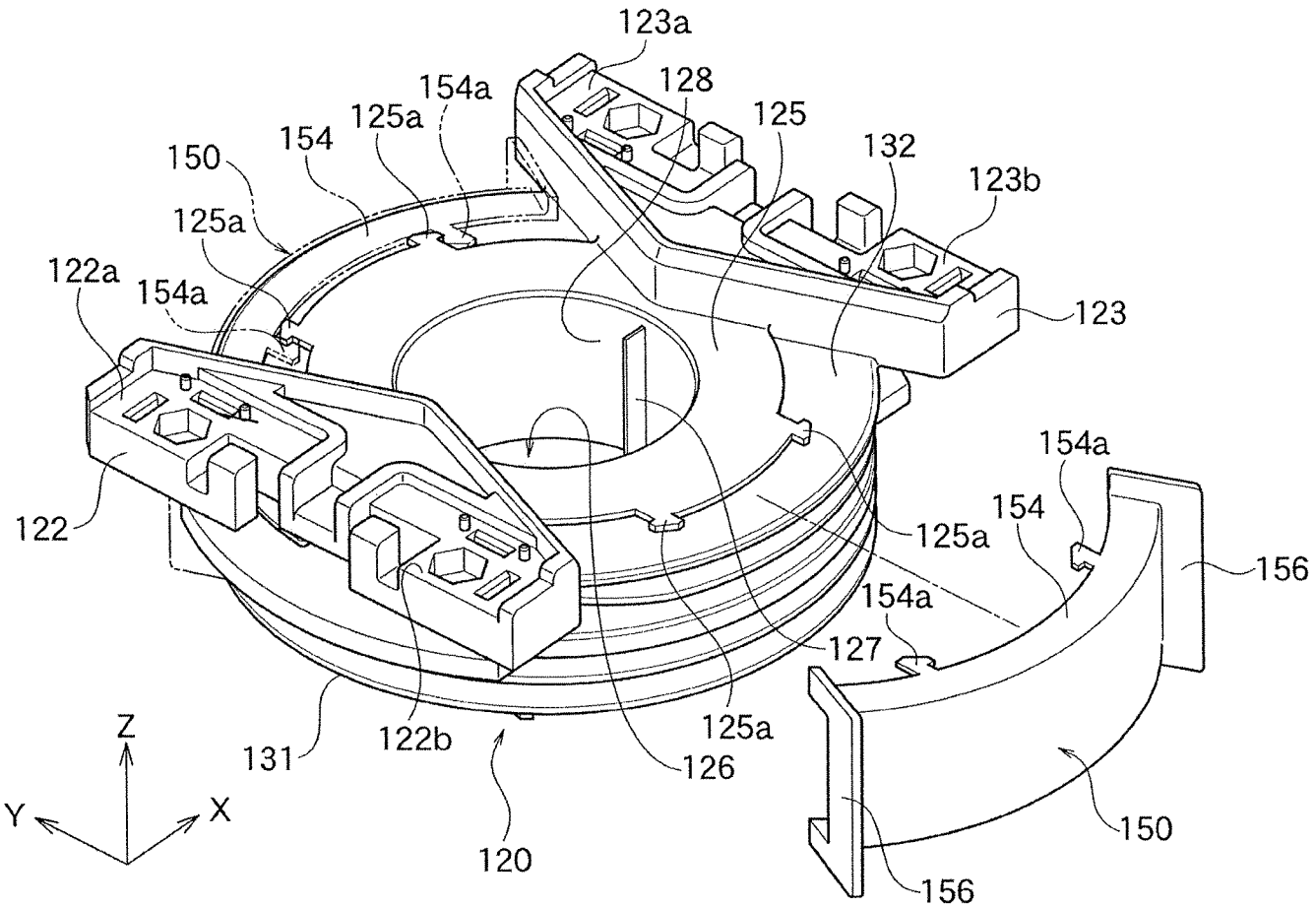
FIG. 7 is a perspective view of the bobbin and the cover shown in FIG. 6.

For the transformer 110 according to the present embodiment illustrated in FIGS. 5 to 7, except for the followings, it has the same structure and the same function effects with the first embodiment. Further, each members of the transformer 110 illustrated in FIGS. 5 to 7 correspond to each member of the transformer 10 in the embodiment illustrated in FIGS. 1 to 4. For the corresponding members, codes are provided so that last two figures of number become the same. The explanations are partly omitted.

The transformer 110 according to the present embodiment illustrated in FIG. 5 is used, as a leakage transformer, for a vehicle-mounted charger and the like. This transformer 110 is provided with a bobbin 120, a magnetic cores 140*a*, 140*b*, a cover 150, and a tape-shaped member 60.

As illustrated in FIGS. 6 and 7, the bobbin 120 is provided with a bobbin body 124, and terminal block parts 122, 123 which are integrally formed on the upper part of both ends of the bobbin body 124 in the X-axial direction. On the terminal block parts 122 and 123, terminal attaching portions 122*a*, 122*b* and 123*a*, 123*b* are respectively formed on both ends of the Y-axis direction, and terminals 121 are attached thereon. As illustrated in FIG. 5, each terminal 121 is connected with lead portions 37*a*, 37*b* of the first wire 37 (abbreviated in FIGS.) and lead portions 38*a*, 38*b* of the second wire 38 (abbreviated in FIGS.).

As illustrated in FIG. 6, in the present embodiment, the magnetic cores 140*a*, 140*b* can be separated into two split cores 142*a*, 142*a* and 142*b*, 142*b* respectively having the same shapes. In the present embodiment, all of split cores 142*a*, 142*a* and 142*b*, 142*b* have the same shapes exhibiting a U shape on the Z-Y cross section, and they related to U-shaped core. By combining a pair of the split cores 142*a*, 142*a* arranged on the upper part of the Z-axis direction, the Z-Y cross section has an E shape and a so-called E-type core is formed. For the other pair of the split cores 142*b*, 142, arranged on the lower part of the Z-axis direction, by combining them, the Z-Y cross section has an E shape and a so-called E type core is formed.

Each split core 142*a* arranged on the upper side of the Z-axis direction is provided with a base portion 144*a* extending in the Y-axis direction and a pair of middle leg portion 146*a* and side leg portion 148*a* protruding toward the Z-axis direction from both ends of the base portions 144*a* in the Y-axis direction. Each split core 142*b* arranged on the lower side of the Z-axis direction is provided with a base portion 144*b* extending in the Y-axis direction and a pair of middle leg portion 146*b* and side leg portion 148*b* protruding towards the Z-axis direction from both ends of the base portion 144*b* in the Y-axis direction.

The pair of middle leg portions 146*a* are inserted into the core leg penetrating hole 126 of the bobbin 120 from the upper part of the Z-axis direction. Similarly, the pair of middle leg portions 146*b* are inserted into the core leg penetrating hole 126 of the bobbin 120 from the lower part of the Z-axis direction, and tips thereof contact with those of the middle leg portions 146*a* or are opposed to those of the middle leg portions 146*a* at a predetermined gap.

On the opposed position, in the X-axis direction, at the inner circumferential surface of the winding cylinder portion 128 forming the penetrating hole 126, a protruding portion 127 for separation is formed along the Z-axis direction. The protruding portion 127 for separation is interposed between the middle leg portions 142*a*, 142*a* as well as between the middle leg portions 142*b*, 142*b*. Further, in the penetrating hole 126, these middle leg portions 142*a*, 142*a* or middle leg portions 142*b*, 142*b* are opposed to each other at the predetermined gap and they do not contact with each other. The predetermined gap can be adjusted by the thickness of the protruding portion 127 for separation of the Y-axis direction.

The middle leg portions 142*a*, 142*a* or the middle leg portions 142*b*, 142*b* are respectively combined and have a columnar shape so that they corresponds to the inner circumferential surface shape of the penetrating hole 126. However, the shape is not particularly limited and may be changed according to the shape of the penetrating hole 126. Further, the side leg portions 148*a*, 148*b* have an inner recessed curved surface shape corresponding to the outer circumferential surface shape of an arc of the cover body 152 of cover 150, and the outer surface thereof has a plane parallel to the X-Z plane.

The cover body 152 of the cover 150 has a shape covering the outer circumference of the bobbin body 124 placed between terminal blocks 122 and 123 of the bobbin 120. On both ends of the cover body 152 of the Z-axis direction, engagement pieces 154, bending substantially vertically from the cover body 152 toward the bobbin body 124, are integrally formed. The pair of engagement pieces 54 formed on both ends of the cover body 152 of the Z-axis direction is attached so as to sandwich upper and lower surfaces of the bobbin body 124 of the Z-axis direction.

As illustrated in FIGS. 6 and 7, on the upper surface of the bobbin body 124, specifically on both end portions of the cylinder portion 128 of the winding axis direction, end partition collars 131, 132 are respectively formed. In the present embodiment, on the end partition collar 132 at the upper side of the Z-axis direction, a thick wall part 125 is provided near the core leg penetrating hole 126. On the outer circumference of the thick wall part 125, a second engagement part 125*a* where a first engagement part provided on the engagement pieces 154 of the cover 150 engages is formed.

Further, on the outer surface of both ends of the cover body 152 of the X-axis direction, side leg guide pieces 156, respectively extending in the Z-axis direction, are integrally formed. At the outer surface of the cover body 152 located between the pair of side leg guide pieces 156, the inner surface of the side leg portions 148*a*, 148*b* contacts, with the result that the movement of the side leg portions 148*a*, 148*b* in the X-axial direction is restricted by the pair of the side leg guide pieces 156.

On the winding cylinder portion 128 located between the end partition collars 131 and 132 in the Z-axis direction, the first winding part 35 and the second winding part 36 shown in FIG. 3 are continuously formed at different positions in the Z-axis direction. The first winding part 35 and the second winding part 36 are explained in detail in the first embodiment, therefore the explanations thereof are abbreviated.

As illustrated in FIGS. 6 and 7, in the second embodiment, on the upper side of the end partition collar 132, the thick wall part 125 is provided near the core leg penetrating hole 126. At the outer circumference of the thick wall part 125, the second engagement parts 125*a* where a plurality of the first engagement parts 154*a* provided on the engagement pieces 154 of the cover 150 engage are formed.

With the above structure, it enables to improve the intensity of the bobbin 120 in comparison with the first embodiment. Further, only minimum parts are made to thick, with the result that it enables to achieve a thin type and downsizing of the transformer 110 in the winding axis direction.

In the second embodiment, the shape of the middle leg portions 146*a*, 146*b* of the magnetic cores 140*a*, 140*b* is circular columnar and it is different from that of the first embodiment having an elliptic columnar shape. In accordance with that, the shapes of the bobbin 120 and the cover 150 in the second embodiment are different from those of the first embodiment. However, both embodiments have basically the same structure and exhibit the same function effects, except for the above-mentioned.

Further, the present invention is not limited to the above-mentioned embodiments and it can be variously modified without departing the principle thereof.

For example, for the transformer 10 of the present embodiment, the aspect for the split of magnetic core may be changed. For example, in the above-mentioned embodiment, the magnetic core is formed by the combination of U core-U core. However, it may be formed by the combination of U core-I core.

DESCRIPTION OF THE PREFERENCE NUMERALS

10 - - - transformer
20 - - - bobbin
22, 23 - - - terminal block part
  22*a*, 22*b*, 23*a*, 23*b* - - - terminal attaching portion
  22*c*, 22*d*, 23*c*, 23*d* - - - lead groove
24 - - - bobbin body
26 - - - core leg penetrating hole
27 - - - protruding portion for separation
28 - - - winding cylinder portion
30 - - - insulating partition collar
31, 32 - - - end partition collar
33, 34 - - - winding partition collar
  33*a*, 34*a* - - - communication groove
35 - - - first winding part
36 - - - second winding part
37 - - - first wire
  37*a*, 37*b* - - - lead portion
38 - - - second wire
  38*a*, 38*b* - - - lead portion
40*a*, 40*b* - - - magnetic core
42*a*, 42*b* - - - split core
44*a*, 44*b* - - - base portion
46*a*, 46*b* - - - middle leg portion
48*a*, 48*b* - - - side leg portion
50 - - - cover
52 - - - cover body
54 - - - engagement piece
56 - - - side leg guide piece
60 - - - tape-shaped member

The invention claimed is:

1. A transformer comprising:

a bobbin, wherein the bobbin is provided with a cylinder portion on which a core leg penetrating hole, where a magnetic core is inserted, is formed, the cylinder portion is provided with a first winding part where a first wire, forming either one of a primary coil or a secondary coil, is wound in respective sections adjacent to each other, and a second winding part where a second wire, forming the another one of the primary coil or the secondary coil, is wound in respective sections adjacent to each other, at a position different from the first winding part in an axial direction, a winding axis of the first wire and a winding axis of the second wire correspond to each other, at an outer circumference of the cylinder portion located between the first winding part and the second winding part, an insulating partition collar adjusting leakage characteristics is formed, at least on the first winding part, a winding partition collar, separating mutually adjacent wire winding parts along the winding axis of the first wire in the respective sections, is formed, each section width, along the winding axis, in the respective sections is set so that only one wire can pass through, a height of the winding partition collar is set so that one or more of the wires can pass through, at the winding partition collar, at least one communication groove, communicating the sections adjacent to each other, is formed, at least the first wire α-wound in the respective sections adjacent to each other on the first winding part has a central part placed in the communication groove, a one side part wound, in one direction, in the sections at a one side of the communication groove, and an another side part wound, in the other direction, in the sections at the another side of the communication groove, a lower part of a winding axis direction is a mounting surface of the transformer, and the bobbin is provided with a terminal block part formed on an upper part in the winding axis direction.

2. The transformer as set forth in claim 1, wherein on the second winding part, a winding partition collar, separating mutually adjacent wire winding parts along the winding axis of the second wire in the respective sections, is formed, on the winding, partition collar of the second winding part, at least one communication groove, communicating the sections adjacent to each other, is formed, and the second wire is α-wound around the second winding part.

3. The transformer as set forth in claim 1, wherein at the inner circumference of the cylinder portion forming the core leg penetrating hole, a protruding portion for separation is formed so that mutual split cores are opposed to each other at a predetermined gap.

4. The transformer as set forth in claim 1 further comprising:

a cover attached on an outer circumference of the bobbin to guide side legs of the magnetic core.

5. The transformer as set forth in claim 4, wherein at end portions of the cylinder portion of the winding axis direction, end partition collars are respectively formed, on either one of the end partition collars, a thick wall is provided near the core leg penetrating hole, and on an outer circumference of the thick wall part, a second engagement part where a first engagement part provided on an engagement piece of the cover engages is formed.

6. The transformer as set forth in claim 1, wherein the terminal block parts are formed on upper parts of both ends of a bobbin body of the bobbin in a X-axial direction.

7. The transformer as set forth in claim 6, wherein terminal attaching portions respectively formed on the terminal block parts are connected with a lead portion of the first wire and a lead portion of the second wire.

8. The transformer as set forth in claim 7, wherein lead grooves respectively leading the lead portions to the upper part in the winding axis direction are formed on the terminal block parts formed on the upper parts of both ends of the bobbin body in the X-axial direction.

9. The transformer as set forth in claim 7, wherein the communication grooves are respectively formed in the opposite sides of the X-axis direction.

10. A leakage transformer comprising the transformer as set forth in claim 1.

* * * * *